US010232489B2

(12) United States Patent
Orlando

(10) Patent No.: US 10,232,489 B2
(45) **Date of Patent: *Mar. 19, 2019**

(54) SETUP PLATFORM APPARATUS FOR BENCH AND PEDESTAL GRINDERS

(71) Applicant: MOTION CONCEPTS, LLC, La Habra, CA (US)

(72) Inventor: Paul Frank Orlando, La Habra Heights, CA (US)

(73) Assignee: MOTION CONCEPTS, LLC, La Habra Heights, CA (US)

( * ) Notice: Subject to any disclaimer, the term of this patent is extended or adjusted under 35 U.S.C. 154(b) by 614 days.

This patent is subject to a terminal disclaimer.

(21) Appl. No.: 14/256,984

(22) Filed: Apr. 20, 2014

(65) Prior Publication Data

US 2014/0227947 A1 Aug. 14, 2014

Related U.S. Application Data

(63) Continuation-in-part of application No. PCT/US2013/065717, filed on Oct. 18, 2013.

(60) Provisional application No. 61/716,438, filed on Oct. 19, 2012.

(51) Int. Cl.

| | |
|---|---|
| ***B24B 41/00*** | (2006.01) |
| ***B24B 27/02*** | (2006.01) |
| ***B24B 27/06*** | (2006.01) |

(52) U.S. Cl.

CPC ..... *B24B 27/02* (2013.01); *B24B 27/0683* (2013.01); *B24B 41/002* (2013.01); *Y10T 29/49826* (2015.01)

(58) Field of Classification Search

CPC ..... B24B 41/06; B24B 27/02; B24B 27/06; B24B 27/0683

USPC ..... 451/406, 241; 29/428

See application file for complete search history.

(56) References Cited

U.S. PATENT DOCUMENTS

| | | | | | |
|---|---|---|---|---|---|
| 844,109 | A | * | 2/1907 | Famous | 451/278 |
| 925,610 | A | * | 6/1909 | Sylvestre | 451/406 |
| 1,081,465 | A | * | 12/1913 | Pribnow | 451/342 |
| 1,430,426 | A | * | 9/1922 | Zongaro | 451/406 |
| 2,157,241 | A | | 5/1939 | Manning | |
| 2,176,726 | A | | 10/1939 | Shepherd | |
| 2,374,716 | A | | 5/1945 | Wiken | |
| 2,415,676 | A | * | 2/1947 | Duckwitz | 451/406 |
| 2,465,399 | A | | 3/1949 | Robinson | |
| 2,814,913 | A | | 12/1957 | Witt | |
| 3,566,550 | A | * | 3/1971 | Piccinno | B24B 41/06 451/279 |
| 4,574,530 | A | | 3/1986 | Handler et al. | |
| 5,337,522 | A | | 8/1994 | Chien | |

(Continued)

*Primary Examiner* — Robert A Rose

(74) *Attorney, Agent, or Firm* — William A. English; Vista IP Law Group LLP

(57) ABSTRACT

A setup platform is provided for a grinder including a cutoff wheel. The setup platform includes an upper planar surface including a first edge, which may be shaped similar to the grinder housing, the first edge including a slot therein for receiving the cutoff wheel. An anchor bar is mounted horizontally to the grinder housing, and a post extending from a lower surface of the setup platform is slidable on the anchor bar such that the setup platform is slidable relative to the anchor bar to removably mount the setup platform to the grinder such that the first edge is disposed adjacent the grinder housing and the cutoff wheel is received in the slot.

19 Claims, 7 Drawing Sheets

(56) References Cited

U.S. PATENT DOCUMENTS

| | | | | |
|---|---|---|---|---|
| D363,296 | S | 10/1995 | Madill | |
| 5,525,095 | A * | 6/1996 | Baughman | B24B 53/14 125/11.03 |
| 6,585,578 | B2 * | 7/2003 | Lin | B24B 27/02 451/349 |
| 6,722,968 | B2 | 4/2004 | Rizzo et al. | |
| 7,779,736 | B2 | 8/2010 | Liu et al. | |
| D627,803 | S | 11/2010 | Jebb | |
| 7,905,223 | B2 | 3/2011 | von Siegroth et al. | |
| 7,950,317 | B2 | 5/2011 | Parks et al. | |
| 9,114,502 | B2 * | 8/2015 | Brooks | B24B 41/06 |

* cited by examiner

SETUP PLATFORM APPARATUS FOR BENCH AND PEDESTAL GRINDERS

RELATED APPLICATION DATA

This application is a continuation-in-part of co-pending International Application No. PCT/US2013/065717, filed Oct. 18, 2013, which claims benefit of provisional application Ser. No. 61/716,438, filed Oct. 19, 2012, the entire disclosures of which are expressly incorporated by reference herein.

FIELD OF THE INVENTION

The present invention relates to tool rests for use with grinders, such as bench and pedestal type grinders, or other tools. More particularly, the present invention relates to the setup platforms or other tool rests, grinders including such platforms or tool rests, and to methods for using them.

BACKGROUND

Standard tool rests, supplied by manufacturers, for a bench or pedestal grinder are designed for use with abrasive grinding wheels only and intended for rough grinding, sharpening tools, deburring, and smoothing sharp edges. After market tool rests are available, such as those made by Veritas Tools P/N (05M23.01), Grizzly Industrial P/N (G8987), Accu-Finish "Grind-R-Table" by Glendo Corporation P/N (001-696), and Tormek P/N (BGM-100). Such tool rests are generally designed for use with abrasive grinding wheels only and intended for rough grinding, sharpening tools, deburring, and smoothing sharp edges.

Currently available tool rests do not allow for the use of abrasive cutoff wheels. Attempting to use an abrasive cutoff wheel on a bench or pedestal grinder to make a cut of any type can be dangerous when using standard tool rests, e.g., those supplied from the manufacturer or current after-market tool rest suppliers. Attempting to use an abrasive cutoff wheel with the above-mentioned tool rests does not allow for any depth of cut without coming off the tool rest and into the rotating wheel, with loss of support to the object being cut. This can be dangerous, e.g., risking the object being cut to catch and be pulled into the rotating abrasive cutoff wheel, possibly along with the operators' fingers and/or hands, even risking shattering the abrasive cutoff wheel and ejecting broken wheel fragments at very high velocities.

Currently available after market tool rests generally require anchoring to the table top on which the bench or pedestal grinder is mounted and not to the grinder itself. Anchoring a grinder tool rest in this manner allows for possible movement between the tool rest and the grinder, which may cause variation in the setup and/or may result in a much higher error and/or scrap ratio when running production that requires repeatability.

Safety is also a potential problem when a grinder tool rest is anchored to the table top on which the bench or pedestal grinder is mounted. For example, the tool rest can move into or away from the abrasive grinding wheel, which can create a hazardous situation. When movement between the tool rest and the grinder during grinding operations creates a gap between the tool rest and the abrasive grinding wheel, the object being ground may catch and be pulled into the rotating grinding wheel. possibly along with the operator's fingers and/or hands. When movement between the tool rest and the grinder during grinding operations causes the tool rest to make contact with the rotating grinding wheel, the tool rest may catch and be pulled into the rotating grinding wheel, again possibly along with the operator's fingers and/or hands.

When an abrasive grinding wheel wears or otherwise needs to be changed, or a different grit or type of wheel is required, currently available tool rests require that the setup or tool rest position be unfastened and moved out of the way in order to remove and install the new abrasive grinding wheel. This requires the operator to "re-setup" the current operation, which may greatly increase setup time and setup costs, and/or concurrently slow down production time and increase production costs.

Accordingly, tool rests that enhance safety and/or facilitate setup, change-out, and/or other production steps would be useful.

SUMMARY

The present application is directed generally to tool rests for use with grinders or other tools, such as bench and pedestal type grinders. More particularly, the present application is directed to setup platforms or other tool rests, which may be mounted to bench and pedestal type grinders or other tools, to grinders including such platforms or tool rests, and to methods for using them.

The setup platform apparatus described herein may overcome one or more of the problems associated with existing tool rests. The apparatus, systems, and methods herein may provide a highly stable setup platform of considerable area that allows safe, accurate, and/or repeatable use of various types of abrasive wheels for cutting and grinding operations, e.g., on bench and pedestal grinders.

The platform may be shaped to fit the profile of the grinder to which it is mounted, e.g., with a plurality of pre-drilled threaded holes about a working surface of the platform. Various profiles, hole configurations, and/or other components of setup platforms may be provided, e.g., having different shapes and/or sizes to correspond to each make, model, and size of grinder for which it is manufactured.

The platform may be mounted to the grinder, e.g., to the grinder housing, and not to the table or pedestal on which the grinder is mounted. This may substantially eliminate movement between the platform and the abrasive wheel, greatly reducing possible variation in the setup, and may provide highly accurate and/or repeatable cutting and grinding operations. Also, by mounting the platform to the grinder, safety problems created by potential movement between the platform and the grinder into or away from an abrasive wheel may be substantially eliminated.

Additional benefits to various embodiments of the apparatus and systems herein may include a unique detachable mounting system that allows removal and reinstallation of the platform without loss of the original setup position accuracy. This may allow the changing of abrasive wheels without unfastening and moving the current setup. This also in turn may consistently reduce setup time and/or speed up production output.

Thus, the apparatus, systems, and methods herein may provide various enhancements over existing tool rests, such as:

1) a setup platform of considerable surface area with features for high precision cuts and grinds with various types of abrasive wheels;

2) a setup platform with features for safe repeatable setups;

3) a setup platform that may allow abrasive wheel changes without loss of the current setup;

4) a setup platform for use in combination with a bench grinder and a pedestal grinder;

5) a setup platform of considerable surface area with a variable profile configuration.

In accordance with one embodiment, a setup platform apparatus is provided for a tool that includes a setup platform including a substantially planar upper surface including a first edge configured to be mounted adjacent the tool, the first edge comprising a slot therein; an elongate member including a first end fixed to the setup platform and a second end extending from a lower surface of the setup platform to define a substantially vertical axis; an anchor bar including a first end configured to be mounted to a portion of the tool to define a substantially horizontal axis orthogonal to the vertical axis, and a second free end configured to receive the second end of the elongate member thereon such that the setup platform is slidable relative to the anchor bar along the horizontal axis. Optionally, one or more fasteners may be provided for securing the elongate member relative to the anchor bar.

In one embodiment, the elongate member may include a first bar clamp, and the one or more fasteners may include a second bar clamp mounted on the first bar clamp such that the first and second bar clamps define a slot therebetween for receiving the first end of the anchor bar. Alternatively, other fasteners may be provided for securing the elongate member relative to the anchor bar, e.g., including a releasable connector, such as a cam-type or other clamping element.

In addition or alternatively, the first end of the anchor bar may include one or more fasteners for securing the first end to a housing of the tool. For example, the tool may be a bench top or pedestal grinder comprising a cutoff wheel, and the first end of the anchor bar may be secured to a wheel guard or other housing of the cutoff wheel. In an exemplary embodiment, the one or more fasteners may include one or more bolts for securing the anchor bar to the grinder housing and/or one or more leveling screws or other fasteners for adjusting the orientation of the anchor bar, e.g., to extend substantially horizontally and/or substantially perpendicular relative to the axis of the abrasive wheel.

Optionally, the apparatus may also include a spark or tool guard, which may be mounted to the grinder or other tool, e.g., to at least partially cover the opening in the wheel guard and/or the abrasive wheel.

In accordance with another embodiment, a method is provided for mounting a setup platform to a bench top or pedestal grinder comprising a cutoff wheel rotatably mounted thereon. A first end of an anchor bar may be mounted to a housing of the grinder adjacent the cutoff wheel such that the anchor bar defines a substantially horizontal axis between the first end and a second free end of the anchor bar. For example, one or more holes may drilled, cut, or otherwise formed through the wheel guard of the grinder, and corresponding bolt(s) may be mounted through the holes and the anchor bar to secure the anchor bar to the wheel guard. Optionally, one or more set screws or other fasteners may also be directed through the anchor bar into or against the wheel guard, e.g., to adjust the orientation of the anchor bar.

A setup platform may be provided that includes a substantially planar upper surface and an elongate member extending from a lower surface of the setup platform. In exemplary embodiments, the upper surface may provide a substantial work area, e.g., greater than the stock tool rest provided with grinders, for example, greater than about sixteen square inches or thirty six square inches (225 $cm^2$). The elongate member may be slid onto the free end of the anchor bar such that the setup platform is directed along the substantially horizontal axis until an inner edge of the setup platform is positioned adjacent the cutoff wheel, and the elongate member may be secured to the anchor bar such that the setup platform is substantially stationary relative to the cutoff wheel. Optionally, the inner edge may include a slot therein and the cutoff wheel may be partially received in the slot when the elongate member is slid onto the anchor bar to position the setup platform adjacent the cutoff wheel. The anchor bar may be oriented substantially horizontally (along its length and/or rotationally) and/or substantially perpendicularly to the wheel axis of the grinder, e.g., to ensure that the upper surface of the setup platform is substantially horizontal and/or the slot is properly aligned with the cutoff wheel.

Optionally, a spark guard may be mounted to the wheel guard of the housing, e.g., to at least partially cover the opening around the cutoff wheel while provided desired clearance around the cutoff wheel. For example, the spark guard may include an "L" shaped bracket including a first panel with a slot therein for receiving the cutoff wheel and a second panel transverse to the first panel. A fastener may be received through the first panel into the wheel guard of the grinder to secure the spark guard, and, when mounted in this manner, the second panel may at least partially cover the axle of the cutoff wheel, e.g., to prevent inadvertent contact with the axle during use.

In accordance with yet another embodiment, a method is provided for mounting a setup platform to a machine tool having a processing wheel, e.g., a cutoff wheel, rotatably mounted thereon. A first end of an anchor bar is mounted to a housing of the tool adjacent the wheel such that the anchor bar extends substantially horizontally between the first end and a second free end of the anchor bar. A setup platform is provided that includes a substantially planar upper surface and an elongate member extending from a lower surface of the setup platform. The elongate member is slid along the anchor bar from the second free end towards the first end of the anchor bar until an inner edge of the setup platform is positioned adjacent the housing and the wheel is received in a slot in the setup platform. The elongate member may then be secured relative to the anchor bar such that the setup platform is substantially stationary relative to the tool.

In accordance with still another embodiment, a system is provided for machining or otherwise processing work pieces that includes a machine tool including a housing and a processing wheel, an anchor member, and a setup platform. The anchor member includes a first end secured to the housing and a second free end extending substantially horizontally from the housing. The setup platform includes a substantially planar upper surface having a slot therein, and a lower surface from which a post extends. The post may be slidably mounted on the anchor member such that the setup platform is directable along the substantially horizontal axis towards the tool until a first edge of the setup platform extends at least partially along the housing of the tool and the wheel is received in the slot. One or more fasteners may be provided for securing the post to the anchor member to thereby secure the setup platform relative to the tool. Optionally, a spark guard may be mounted to the housing of the tool, e.g., the wheel housing to at least partially cover the opening adjacent the processing wheel, e.g., to cover an axle of the processing wheel.

As described elsewhere herein, exemplary embodiments may be provided and various methodologies may be used in order to produce repeatable high precision cuts and grinds with various types of abrasive wheels.

Other aspects and features of the present invention will become apparent from consideration of the following description taken in conjunction with the accompanying drawings.

BRIEF DESCRIPTION OF THE DRAWINGS

The drawings illustrate exemplary embodiments of the invention, in which.

DETAILED DESCRIPTION OF THE EXEMPLARY EMBODIMENTS

Figure 1A:
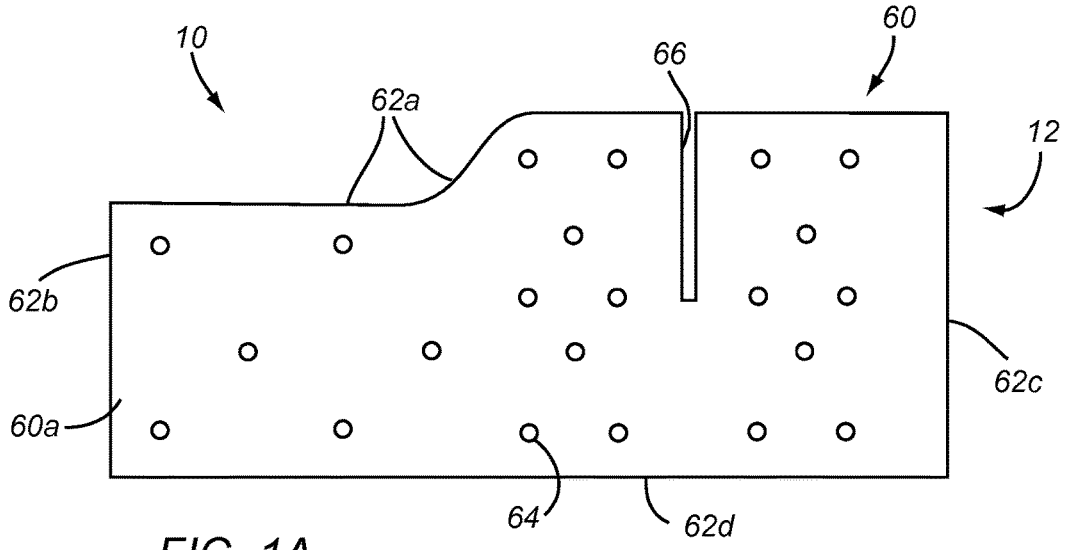
FIGS. 1A and 1B are top and side views, respectively, of an exemplary embodiment of a setup platform.

Turning to the drawings, FIGS. 1A-1D show an exemplary embodiment of a cutoff wheel setup platform apparatus 10 that generally includes a setup platform 12 (shown in FIGS. 1A and 1B) and an anchor bar 20 (shown in FIGS. 1C and 1D) for securing the setup platform 12 to a grinder or other tool (not shown). The setup platform 12 generally includes a work surface member 60, an optional platform base 50 attached to the work surface member 60, and a post 14 extending substantially perpendicular from or otherwise orthogonal to the platform base 50 and work surface member 60, thereby defining a substantially vertical axis "V" for the setup platform 12. As described elsewhere herein, the setup platform 12 may be mounted substantially horizontally relative to the tool, e.g., to provide a work surface to which one or more setup components (not shown) may be mounted. It will be appreciated that a setup platform 12 may be provided with little modification for any abrasive grinding wheel or similar tool based on the embodiments described herein.

Generally, the work surface member 60 may be a plate, e.g., having a thickness between about 1/16 to 1/4 inch (1.6-6.4 mm), including a substantially planar upper or work surface 60*a* and a lower surface 60*b*, e.g., to which the platform base 50 may be attached. In addition, the work surface member 60 includes a plurality of peripheral edges 62*a*-62*d* defining the outer edges of the work surface 60*a*. For example, the work surface member 60 may include an inner or first edge 62*a* having a desired profile configuration, e.g., corresponding to the profile of a grinder or other tool to which the setup platform 60 is mounted.

As shown, the inner edge 62*a* includes a curvilinear shape, e.g., a pair of substantially straight edges separated by a curved edge such that the straight edges extend substantially parallel to, but offset from, one another. Alternatively, the inner edge 62*a* may be substantially straight (not shown) or may have other desired shapes, e.g., corresponding to the portion of a machine tool against which the inner edge 62*a* is mounted during use. Thus, in this alternative, the upper surface 60*a* may have a substantially square or rectangular shape. The other edges 62*b*-62*d* may have any desired shape, e.g., substantially straight shapes as shown, to provide a generally rectangular work surface 60*a* other than the offset along the first edge 62*a*.

In addition, the work surface member 60 may include a cutoff wheel clearance slot 66 of a certain size and length placed at any position needed, for example, extending partially across the width of the work surface member 60 from the inner edge 62*a*, e.g., having a width between about 1/16 to two includes (1.6-50 mm) and a length extending across the width of the work surface member 60 between about one and ten inches (25-250 mm) or between about three and six inches (75-150 mm). For example, the profile of the inner edge 62*a* may correspond to the profile of a grinder such that a grinding wheel of the grinder (not shown) may be received within the slot 66 yet have sufficient clearance to operate freely, as described elsewhere herein.

The upper surface 60*a* may provide a substantial work surface area, e.g., having an overall length, for example, between opposite side edges 62*b*-62*c* (as shown in FIG. 1A), between about six and eighteen inches (6-18 in), a maximum width, for example, between inner and outer edges 62*a*-62*d*, between about four and twelve inches (4-12 in), and/or a surface area between about 16-216 square inches. Optionally, a plurality of holes 64 and/or other features may be provided in or on the work surface member 60, e.g., extending through the upper surface 60*a* at least partially through to the lower surface 60*b*. The holes 64, which may be sized to receive desired corresponding fasteners or other mounts (not shown) may be provided at any position needed, e.g., extending entirely through the upper surface 60*a* to the lower surface 60*b*, in a grid pattern, in an arc pattern, and the like.

The platform base 50 may also be a plate including an upper surface 50*a* attached to the lower surface of the work surface member 60, and a lower surface 50*b* to which the post 14 may be attached. If the holes 64 extend completely through the work surface member 60, optionally corresponding holes (not shown) may be provided into or through the platform base 50, e.g., where they underlie corresponding holes 64. The platform base 50 may have a thickness greater than the work surface member 60, e.g., to enhance the rigidity of the work surface member 60 and/or enhance attachment of the post 14 relative to the work surface member 60. Alternatively, the platform base 50 may be omitted and the post 14 attached directly to the lower surface 60*b* of the work surface member 60, if desired.

Figure 1B:
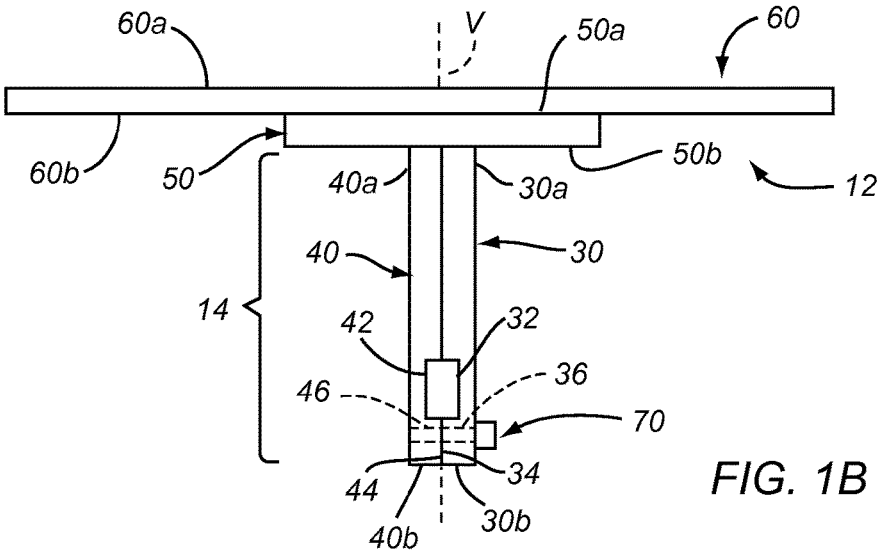
Figure 1C:
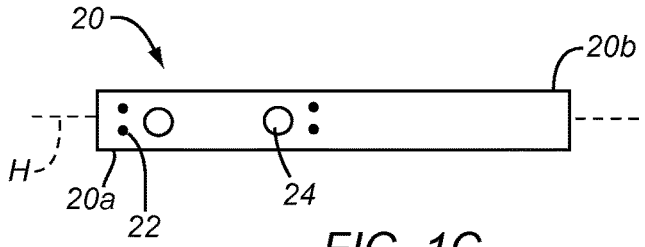
FIGS. 1C and 1D are side and end views, respectively, of an exemplary embodiment of an anchor bar for mounting the setup platform to a tool.
Figure 1D:
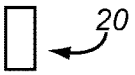
Figure 2:
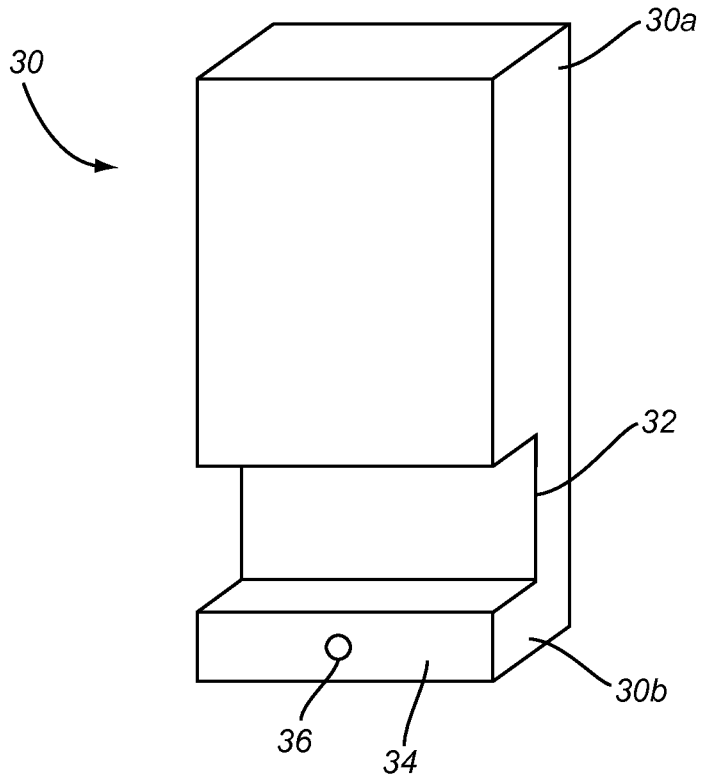
FIG. 2 is a perspective view of an exemplary embodiment of a bar clamp for the platform of FIGS. 1A-1B, including a bar clamp offset surface, which may be used to secure the setup platform to the anchor bar.

In the embodiment shown in FIG. 1B, the post 14 includes a pair of bar clamps 30, 40, each including a first or upper end 30*a*, 40*a* attached or otherwise fixed relative to the platform base 50, and a second free or lower end 30*b*, 40*b*, thereby defining the substantially vertical axis "V" therebetween. As shown in FIG. 2, at least one bar clamp 30 may include a slot 32 to accept the anchor bar 20, and an offset surface 34 or other feature between the slot 32 and the lower end 30*b* to allow the compression or clamping of the lower end 30*b* of the bar clamp 30 towards the other bar clamp 40. In the embodiment shown in FIG. 1B, both bar clamps 30, 40 include slots 32, 42 and offset surfaces 34, 44 that are aligned opposite one another to define an aperture for receiving the anchor bar 20 with an interference fit, as described elsewhere herein. Alternatively, only one of the bar clamps 30, 40 may include a slot (not shown) sized to receive the anchor bar 20 within the slot and against the other bar clamp.

Each bar clamp may include a plurality of holes 36, 46 therethrough, e.g., of a desired type (e.g., threaded or unthreaded) and/or size placed at any position, e.g., adjacent the lower ends 30*b*, 40*b* to accept corresponding bar clamp clamping fasteners 70. For example, the fasteners 70 may be bolts or screws that pass through an unthreaded hole in one bar clamp and then into a threaded hole in the other bar clamp to allow the bar clamps 30, 40 to be secured together. Alternatively, both holes may be threaded or both may be unthreaded and the fasteners 70 may pass freely through the holes and be secured by nuts or other mating fasteners (not shown). In a further alternative, a cam-type or other clamping element (not shown) may be provided to releasably secure the bar clamps 30, 40 (or other embodiment of the post 14) relative to the anchor bar 20.

Alternatively, the bar clamps 30, 40 may be attached to the platform base 50 such that a relatively small gap is provided between the bar clamps 30, 40, e.g., at the lower ends 30*b*, 40*b* in addition to or instead of the offset surfaces 34, 44. In this manner, the width of the aperture defined by the slots 32, 42 may be adjusted, e.g., to initially provide clearance to allow the anchor bar 20 to be freely received therein, and then be compressed or otherwise clamped when the fasteners 70 are tightened to engage the anchor bar 20 between the bar clamps 30, 40. In an alternative embodiment, only one of the bar clamps may be attached or otherwise fixed to the platform base 50 and the other bar clamp may be removably or adjustably coupled to the fixed bar clamp, e.g., by one or more fasteners (not shown).

In a further alternative, a single bar clamp (not shown) may be attached to the platform base 50 that includes a slot or opening in the lower end sized to receive the anchor bar 20, and another bar clamp or cover may be provided that may be attached over the slot, and one or more fasteners 70 may be extended through the cover and bar clamp, thereby engaging the anchor bar 20 therebetween. Thus, in any of these embodiments, the aperture defined by the slots 32, 42 (or a single slot in one of the bar clamps) may initially provide clearance for the anchor bar 20 and then compressed or clamped to engage the anchor bar 20. The slots 32, 42 (or other opening through the post 14) may have a shape corresponding to the cross-section of the anchor bar 20, e.g., a square or other rectangular shape, oval, hexagonal, octagonal, other polygonal shape that may limit the orientation of the anchor bar 20 being inserted into the slots 32, 42, or a circular shape (not shown), as desired.

The setup platform 12 and anchor bar 20 (as well as any fasteners) may be formed from a variety of materials having desired properties, e.g., rigidity, durability, and the like, for use as setup platform for a grinder or other tool. In exemplary embodiments, the work surface member 60, platform base 50, bar clamps 30, 40, and/or anchor bar 20 may be formed from metals, such as cold rolled steel, stainless steel, aluminum, and the like, plastic, or composite materials. The components may be formed by machining, casting, forging, molding, extruding, and the like.

The work surface member 60, platform base 50, and bar clamps 30, 40 may be substantially permanently attached to one another, e.g., by welding, soldering, riveting, bonding with adhesive, and the like, and/or one or more components may be integrally formed together, e.g., by machining, forging, casting, extruding, and the like. Alternatively, the components may be removably attached to one another, e.g., by one or more fasteners, such as one or more bolts, screws, and the like (not shown).

Figure 3:
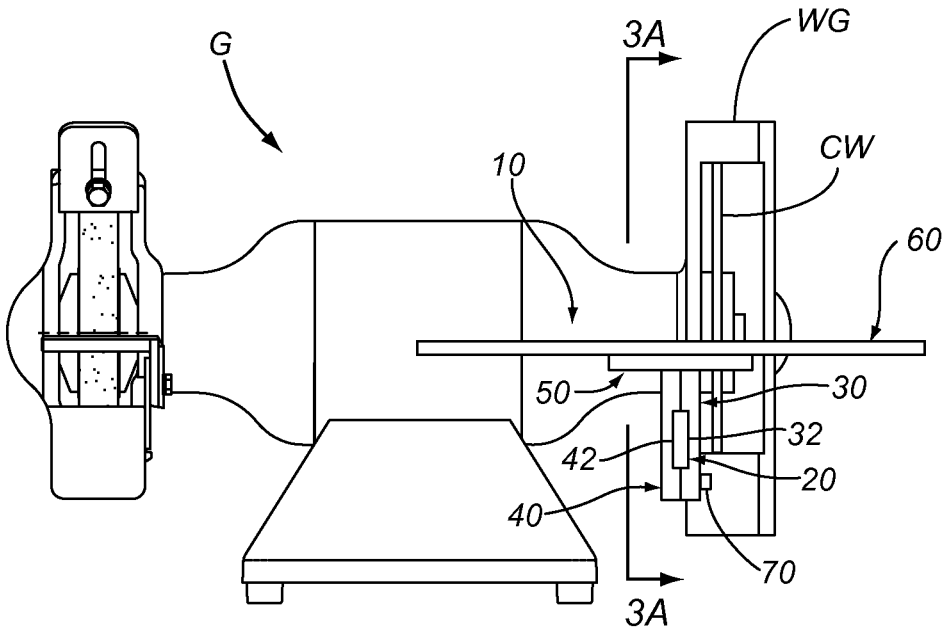
FIG. 3 is a front view of the platform of FIGS. 1A-1B, mounted to a bench grinder.
Figure 3A:
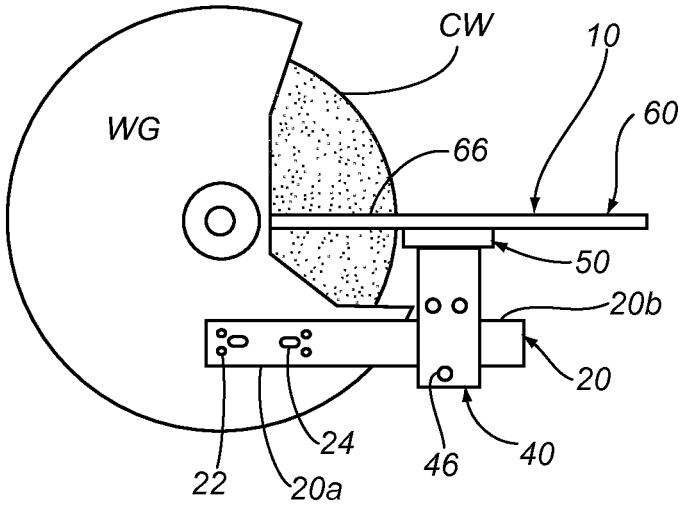
FIG. 3A is cross-sectional view of the setup platform and grinder of FIG. 3 taken along line AA-AA.

For example, with additional reference to FIGS. 3 and 3A, the platform base 50 may be secured to one or both of the bar clamps 30, 40 at the upper ends 30*a*, 40*a* of the bar clamps 30, 40, e.g., by welding, bonding with epoxy or other adhesive, using one or more fasteners, such as bolts, rivets, or screws (not shown), and the like. The work surface member 60 may be removably attached to the platform base 50 at a position required for the intended grinder. In an exemplary embodiment, the work surface member 60 may include one or more hole arrangements in its lower surface 60*b* and/or the platform base 50 may include one or more hole arrangements (not shown), and one or more fasteners, e.g., bolts, screws, rivets, and the like, may be extended through the platform base 50 into respective holes in the lower surface 60*b* of the setup platform 60.

In this manner, the setup platform 12 may accommodate different horizontal spacing of the work surface member 60 needed for different size or shape tools. Alternatively, the platform base 50 may be substantially permanently mounted to or integrally formed with the setup platform 60, e.g., attached together by welding, bonding with epoxy or other adhesive, fasteners, such as bolts, rivets, or screws, and/or other methods. In this alternative, different models of combinations of work surface members 60 and platform bases 50 may be provided to accommodate different size and/or shape tools.

Similarly, the bar clamps 30, 40 may be substantially permanently or removably attached to the platform base 50, e.g., by welding, bonding with epoxy or other adhesive, fasteners, such as bolts, rivets, or screws, and/or other methods. Alternatively, the platform base 50 and post 14 may be integrally formed as a single piece, e.g., by machining, forging, casting, extruding, and the like. For example, one end of a first bar clamp may be substantially permanently attached to or received in a recess in a lower surface 50*b* of the platform base 50, and the other bar clamp may be removably mounted to a side surface of the first bar clamp. Alternatively, both bar clamps 30, 40 may be substantially permanently or removably attached to the lower surface 50*b* of the platform base 50.

Returning to FIGS. 1C and 1D, the adjustable anchor bar 20 may slidably receive the bar clamps 30, 40 of the post 14 thereon for mounting the setup platform 12 to a tool, such as a bench-top or pedestal grinder (not shown). As described further elsewhere herein, the anchor bar 20 may be secured to a housing or other region of the tool (not shown), thereby defining a substantially horizontal axis "H" substantially perpendicular to the substantially vertical axis "V" of the post 14. The anchor bar 20 generally is a substantially straight member, e.g., a hollow tubular body or solid rod having a cross-section similar to the slots 32, 42 in the clamp bars 30, 40, e.g., e.g., a square or other rectangular shape, oval, hexagonal, octagonal, other polygonal shape, which may allow the clamp bars 30, 40 to be received on the anchor bar 20 in only one orientation, or a circular or other symmetrical shape, as desired.

The anchor bar 20 generally includes a first mounting end 20*a* including a plurality of holes, e.g., squareness adjusting holes 22 and mounting holes 24, for receiving corresponding screws, bolts, or other fasteners (not shown), and a second free end 20*b* over which the setup platform 12 may be received. For example, the mounting holes 24 may be relatively large compared to the squareness adjusting holes 22, e.g., sized to receive bolts (not shown) that may be inserted through the mounting holes 24 into corresponding holes (not shown) in the wheel housing of a grinder or other tool (not shown). Set screws (also not shown), as described elsewhere herein.

Figure 7:
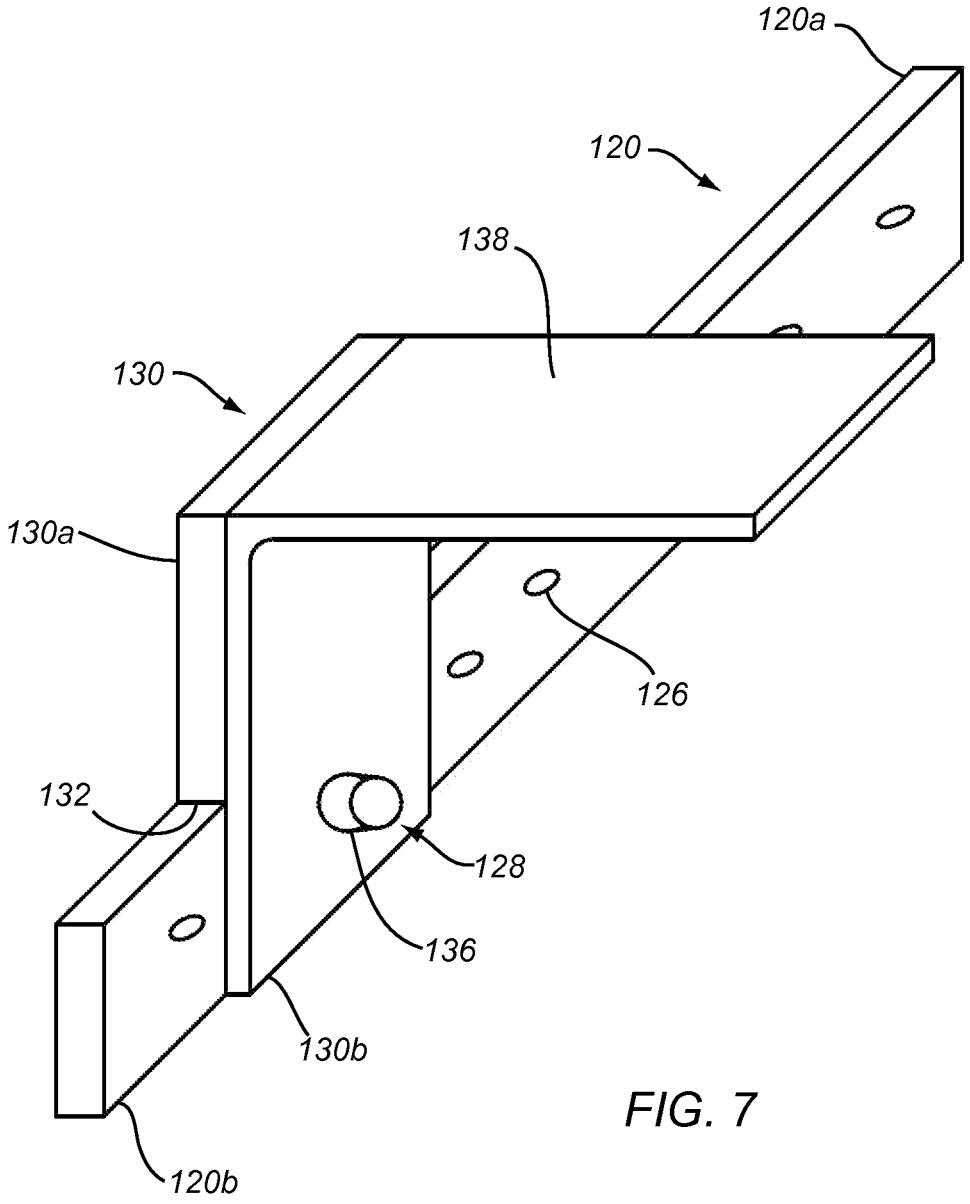
FIG. 7 is a perspective view of an alternative embodiment of an anchor bar and post for a setup platform.

Turning to FIG. 7, in an alternative embodiment, an anchor bar 120 may be provided that includes a first mounting end 120*a* and a second fee end 120*b*, generally similar to the previous embodiments. In addition, the anchor bar 120 includes a plurality of substantially round holes or elongate slots 126 spaced apart from one another between the first and second ends 120*a*, 120*b*, e.g., at a desired spacing. The holes 126 may be threaded or smooth for receiving a bolt or other fastener 128 therethrough.

In this embodiment, a post 130 may be provided that includes a first or upper end 130*a* and a second or lower end 130*b*, generally similar to the previous embodiments. However, the lower end 130*b* may include a recess or groove 132 that may be engaged with the anchor bar 120 and one or more holes or slots 136 (one shown) that may receive one or more respective fasteners 128 (one shown). For example, the recess 132 may define a lip that may be placed on the anchor bar 120 and slid along the anchor bar 120, although alternatively, the recess 132 may be omitted, and the lower end 130*b* of the post 130 may simply be aligned and lapped on the anchor bar 120 (not shown). Thus, the lower end 130*b* of the post 130 may be positioned on the anchor bar 120 at a desired location between the first and second ends 120*a*, 120*b* and the holes 126, 136 aligned such that fastener(s) 128 may be received therethrough to secure the post 130 at the desired location. In this embodiment, the post 130 may be positioned at one or more discrete locations based on the arrangement of openings 126 provided on the anchor bar 120. Optionally, one or more of the holes 126 or 136 may be an elongate slot, e.g., to allow fine adjustment of the post 130 relative to the anchor bar 120, e.g., at positions between the set spacing of the holes 126 in the anchor bar 120.

Although not shown in FIG. 7, a setup platform may be mounted to the upper end 130*a* of the post 130. For example, as shown, the post 130 may be an "L" shaped bracket providing a substantially flat and/or horizontal mounting surface 138 on the upper end 130*a* to which a work surface member and/or optional platform base may be mounted, similar to the embodiment shown in FIGS. 1A-1D. For example, a work surface member may be welded or otherwise substantially permanently attached to the upper end 130*a* of the post 130, also similar to other embodiments herein.

Alternatively, a work surface member may be removably and/or adjustably mounted to the upper end 130*a* of the post 130. For example, one or more slots or other openings (not shown) may be provided in the horizontal mounting surface 138 of the post 130 for receiving respective bolts or other fasteners from the work surface member (also not shown). The slot(s) may allow the work surface member to be adjusted relative to a grinder or other tool to which the anchor bar 120 is mounted. For example, with the post 130 mounted on the anchor bar 120 the slot(s) may allow the work surface member to be adjusted laterally (e.g., left or right) relative to the grinder or tool (not shown), e.g., to align a grinder or wheel within a wheel slot of the work surface member. Optionally, the slot(s) may also allow further lateral adjustment of the work surface member as the grinder wheel wears, e.g., to maintain desired spacing and/or other tolerances between the grinder wheel and a wheel slot in the work surface member.

Turning to FIGS. 3 and 3A, during use, the setup platform apparatus 10 (or any other embodiment herein) may provide a cutoff wheel setup platform that is mountable to a bench grinder G including a cutoff wheel CW or other tool. A "cutoff wheel" is a relatively thin circular wheel including cutting elements for cutting through work pieces, e.g., compared to a grinding wheel, which is a relatively wide circular wheel for grinding, sharpening tools, deburring, and smoothing sharp edges. In exemplary embodiments, a cutoff wheel may have a thickness between about 1/32 and 1/4 inch (0.8-1.6 mm) and a diameter between about one and thirty inches (2.5-75 cm) or between about one and ten inches (2.5-25 cm).

Initially, the anchor bar 20 may be mounted to the housing of the grinder G, e.g., to provide a substantially horizontal mounting axis "H" for the setup platform 12. In an exemplary embodiment, the first end 20*a* of the anchor bar 20 may be attached to the outside of the wheel guard WG facing the grinder motor housing M of the grinder G, e.g., by inserting fasteners (not shown) through mounting holes 24 into the wheel guard WG, as best seen in FIG. 3A. For example, corresponding holes (not shown) may be drilled, cut, or otherwise formed in the flat sidewall of the wheel guard WG that are aligned with and sized similarly to the mounting holes 24 in the anchor bar 20. Bolts, rivets, or other fasteners (sufficiently short not to interfere with rotation of the cutoff wheel CW) may be inserted through the holes 24 and nuts or other fasteners (not shown) used to tighten or otherwise secure the bolts and consequently the anchor bar 20 to the wheel guard WG. Alternatively, the first end 20*a* of the anchor bar 20 may be substantially permanently attached to the wheel guard WG, e.g., by welding, riveting, bonding with epoxy or other adhesive, and the like. If desired, the anchor bar 20 may be substantially squared to the flat sides of the mounted abrasive cutoff wheel CW, e.g., using squareness adjustment or set screws (not shown). For example, the anchor bar 20 may include adjustment holes 22, also as best seen in FIG. 3A, through which set screws may be threaded or otherwise inserted until the set screws engage or at least partially penetrate into the side wall of the wheel guard WG. In this manner, the anchor bar 20 may be fixed in a substantially horizontal orientation extending substantially perpendicular to the rotation axis of the cutoff wheel CW with the anchor bar 20 squared to the wheel guard WG, thereby creating a substantially stable, accurate base to accept the setup platform 12.

The setup platform 12 may then be removably mounted relative to the grinder G, e.g., mounted relative to the cutoff wheel CW, such that the upper work surface 60*a* of the work surface member 60 is positioned in front of and/or around the cutoff wheel CW. Thus, one or more work pieces (not shown) may be cut or otherwise processed using the cutoff wheel CW with the support of the work surface 60*a* and/or or one or more accessories (not shown) mounted to the work surface 60*a*.

Figure 4:
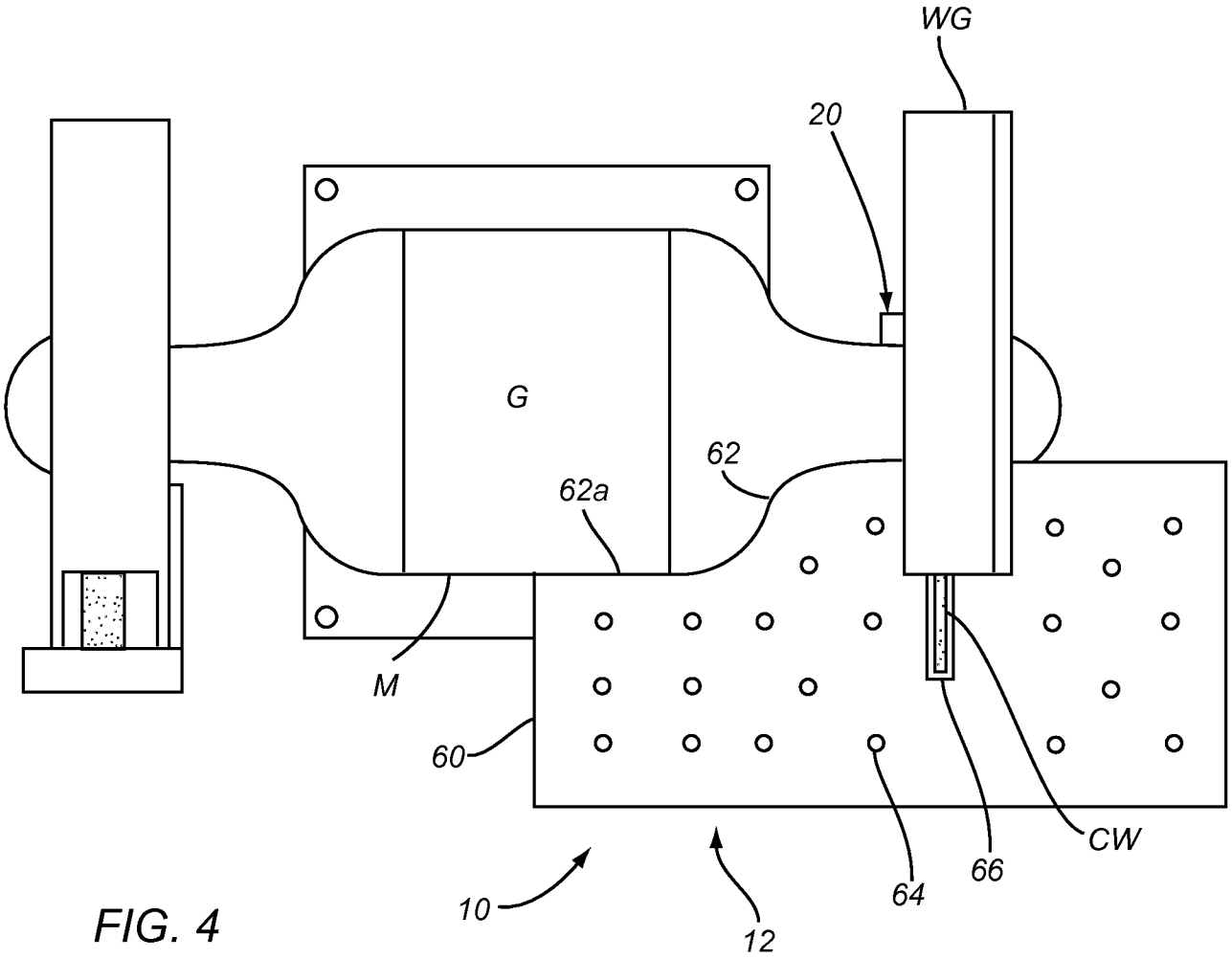
FIG. 4 is a top view of the setup platform and grinder of FIG. 3.

For example, with the bar clamps 30, 40 loose (to increase the width of the aperture defined by the slots 32, 42), the free end of the anchor bar 20 may be inserted through the slots 32, 42, and the setup platform 12 may be slid onto the anchor bar 20 along the substantially horizontal axis "H" of the anchor bar 20 towards the grinder G and the cutoff wheel CW. As the setup platform 12 is advanced towards the grinder G, the cutoff wheel CW may be inserted into the wheel slot 66. As shown in FIG. 4, the setup platform 12 may be advanced until the inner edge 62*a* of the work surface member 60 contacts or is spaced apart a desired offset distance from the motor housing M and/or the wheel guard WG of the grinder G. Alternatively, the anchor bar 20 may include one or more stops (not shown), for limiting advancement of the setup platform 12 until the inner edge 62*a* abuts or is spaced apart a desired offset distance from the grinder G. Optionally, if the setup platform 60 is not substantially horizontal, the set screws and/or other fasteners securing the anchor bar 20 to the grinder G may be adjusted, as desired, to ensure the setup platform 60 is substantially horizontal.

The bar clamps 30, 40 may then be tightened together by fastener(s) 70 received through corresponding holes 36, 46 such that the material adjacent the slots 32, 42 compresses around the anchor bar 20, e.g., due to shorter offset surfaces 34, 44 as shown in FIG. 2 (or other spacing of the lower ends 30*b*, 40*b*), as the fastener(s) 70 are tightened. In an alternative embodiment, if desired, the bar clamps 30, 40 (or posts of other setup platforms described elsewhere herein) may be substantially permanently attached to the anchor bar 20, e.g., by one or more of welding, soldering, screwing, riveting, bonding with adhesives, brazing, and the like. When the setup platform 12 is secured in the desired position on the grinder G, the abrasive cutoff wheel CW is positioned, e.g., centered, within the wheel slot 66, e.g., as shown in FIG. 4, with minimal clearance. The upper surface 60*a* of the work surface member 60 may provide a substantially horizontal work surface for supporting work pieces and/or accessories (not shown).

The resulting assembly may provide a safe and/or substantial platform area that is extremely accurate, consistently repeatable, highly stable, and very easy to use. For example, after the cutoff wheel CW has been used to perform desired actions on one or more work pieces, the cutoff wheel CW may become worn and need to be replaced with a new cutoff wheel. To accomplish this change-out, the fastener(s) 70 may be loosened, and the setup platform 12 slid horizontally away from the grinder G and off the anchor bar 20. The cutoff wheel CW may then be exchanged freely without any interference from the setup platform 12. The setup platform 12 may then be secured again to the anchor bar 20 and grinder G, as described previously, in substantially the same arrangement.

Figure 5:
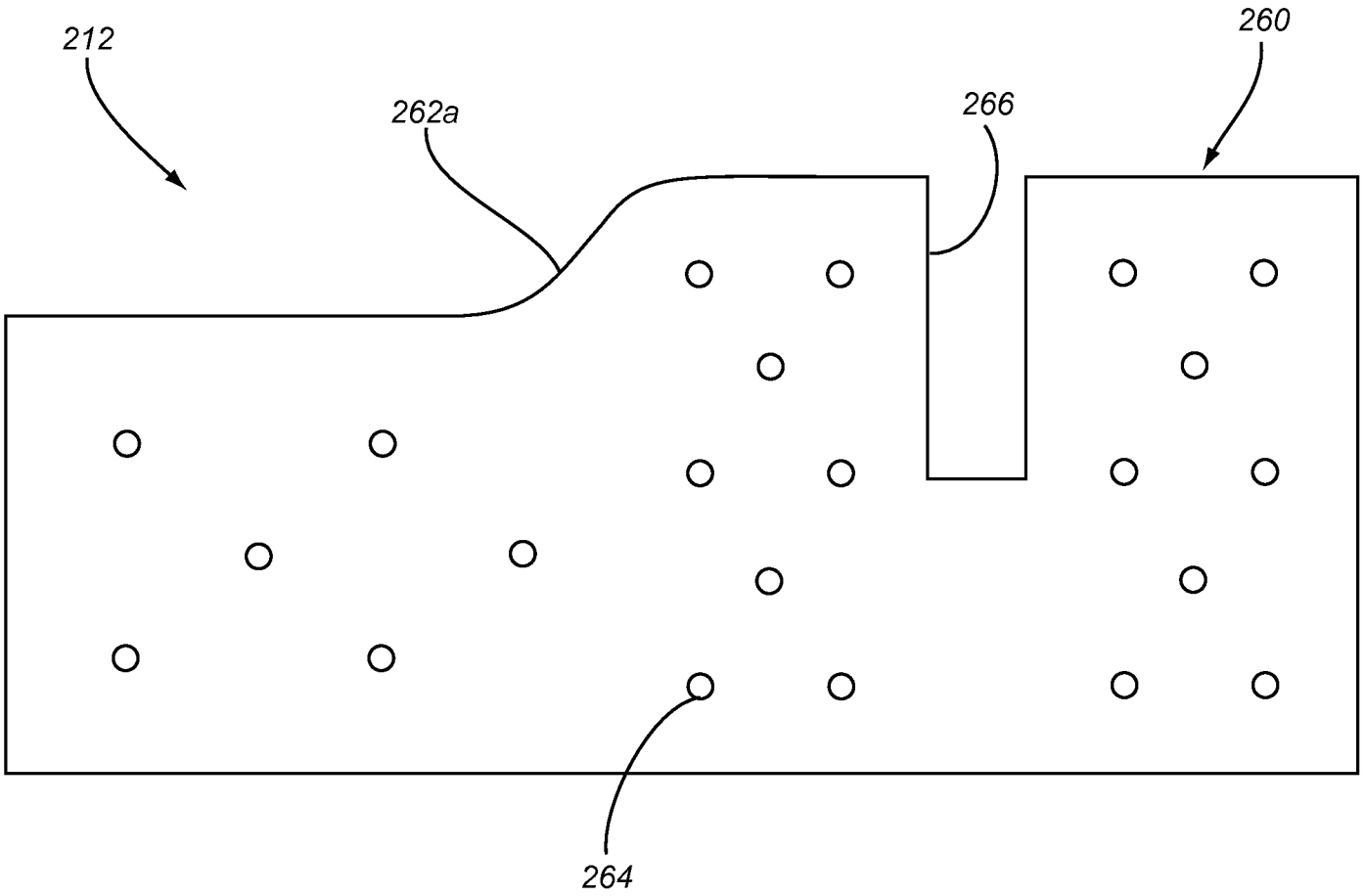
FIG. 5 is a top view of another exemplary embodiment of a setup platform.

Turning to FIG. 5, another exemplary embodiment of a setup platform 212 is shown that works in a similar manner to the setup platform 12 of FIGS. 1-4. For example, the setup platform 212 may generally include a work surface member 260, platform base, and post (not shown), which may be formed from components and desired materials, similar to other embodiments herein. As shown, the work surface member 260 may include a desired profile configuration, e.g., including an offset along a first or inner edge 262*a* corresponding to the shape of a tool to which the setup platform 212 is mounted, and an abrasive grinding wheel clearance slot 266 (e.g., wider than the wheel slot 66) of a certain size and length placed at any position needed to accommodate a grinding wheel (not shown). Optionally, the work surface member 60 may include any number of holes 264 of a certain type and size placed at any position needed. The setup platform 260 may be mounted on an anchor bar (not shown), similar to other embodiments herein, e.g., in a substantially horizontal orientation.

In this embodiment, the abrasive grinding wheel slot 266 may be reconfigured as needed and placed in any position needed to accept any size abrasive grinding wheel that will fit the specific make, model, and/or size bench or pedestal grinder for which it has been manufactured. For example, the work surface member 260 may include an adjustable plate or panel (not shown) adjacent the grinding wheel slot 266 that may be slid and fixed in one or more positions, e.g., thereby reducing the width of the slot 266, as desired.

Figure 6A:
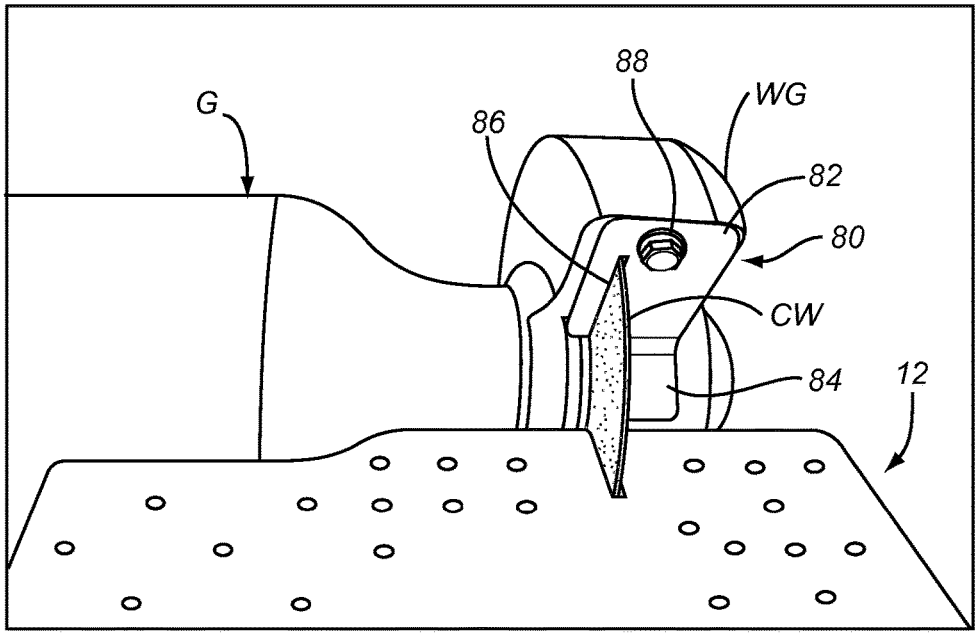
FIGS. 6A and 6B are perspective views of a bench grinder including a setup platform and a spark guard mounted to the wheel housing of the grinder.
Figure 6B:
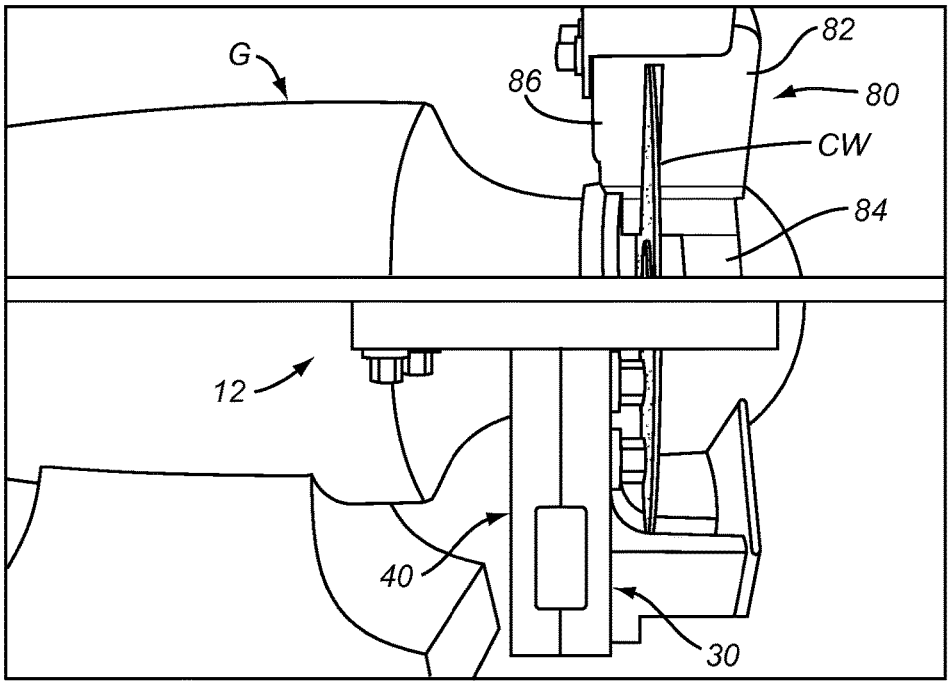

Turning to FIGS. 6A and 6B, in any of the embodiments herein, a spark guard 80 may be provided, e.g., to at least partially cover the opening in the wheel guard WG of the grinder G (or other tool). In the embodiment shown, the spark guard 80 is a generally "L" shaped bracket including a first panel 82 with a slot 86 therein, e.g., for receiving the cutoff wheel CW therein, and a second panel 84 substantially perpendicular or otherwise transverse to the first panel 82. A fastener 88 may be received through the first panel 82 into the wheel guard WG of the grinder G to secure the spark guard 80. For example, a hole (not shown) may be drilled, cut, or otherwise formed (or already provided) in the wheel guard WG of the grinder G, e.g., above the cutoff wheel CW, and a bolt or other fastener 88 may be inserted through a hole in the first panel 82 and the hole in the wheel guard WG, and tightened or otherwise secured in place to secure spark guard 80 across the opening in the wheel guard WG. Optionally, the spark guard may have other shapes to conform to the existing wheel guard of the grinder G, e.g., including a flange or other member (not shown) that extends around a side wall of the wheel guard to receive one or more fasteners through corresponding hole(s) formed or provided in the wheel guard.

When mounted in this manner, the first panel 82 may cover an upper portion of the opening in the wheel guard WG, e.g., with the cutoff wheel CW or other processing wheel, receiving with the slot 86 with sufficient clearance to allow free rotation. The second panel 84 may at least partially cover a lower portion of the opening in the wheel guard WG, e.g., to cover the axle (not shown) of the cutoff wheel CW, e.g., to prevent inadvertent contact with the axle during use. Thus, the spark guard may protect the user and/or reduce the risk of tools, work pieces, or other objects from entering the opening of the wheel guard WG and/or contacting the axle of the cutoff wheel CW, which may damage the object and/or injure the user.

In an alternative embodiment, a platform apparatus may be provided that includes a setup platform that is mounted substantially vertically on an anchor bar (not shown), e.g., for mounting the setup platform relative to a grinder or other tool. Unlike the previous embodiments, the anchor bar has a vertical opening therethrough, and the setup platform includes a shaft extending substantially vertically or substantially perpendicular from the setup platform. The free end of the shaft may be received in the opening in the anchor bar, and a clamp or other feature may be used to secure the shaft relative to the anchor bar. Thus, in this embodiment, the setup platform may be mounted and removed substantially vertically relative to the grinder rather than substantially horizontally. One disadvantage of this embodiment is that the wheel guard of the grinder may interfere with mounting and removing the setup platform, e.g., if the wheel guard cowls over the grinding wheel. In this situation, a portion of the wheel guard may be removed to accommodate mounting and removing the setup platform.

The spirit of the present invention provides a breadth of scope that includes all methods of making and using it and all applications of abrasive cutoff wheels and grinding wheels on bench and pedestal grinders. Any variations on the theme and methodology of accomplishing the same that are not described herein would be considered under the scope of the present invention.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the scope of the appended claims.

I claim:

1. A setup platform apparatus for a tool, comprising: a setup platform comprising a substantially planar upper surface including a first edge configured to be mounted adjacent the tool, the first edge comprising a slot therein; an elongate member including a first end fixed to the setup platform and a second end extending from a lower surface of the setup platform to define a substantially vertical axis; an anchor bar including a first end configured to be mounted to a portion of the tool to define a substantially horizontal axis orthogonal to the vertical axis, and a second free end configured to engage the second end of the elongate member such that the setup platform is mountable relative to the anchor bar along the horizontal axis; a first set of one or more fasteners for securing the elongate member relative to the anchor bar; and a second set of one or more fasteners for securing the first end of the anchor bar to a housing of the tool, wherein the first end of the anchor bar comprises one or more holes for receiving respective one or more fasteners of the second set for securing the first end to a housing of the tool.

2. The apparatus of claim 1, wherein the elongate member comprises a first bar clamp, and the one or more fasteners comprise a second bar clamp mounted on the first bar clamp such that the first and second bar clamps define a slot therebetween for receiving the second end of the anchor bar.

3. The apparatus of claim 1, wherein the elongate member comprises first and second bar clamps fixed to the setup platform such that the first and second bar clamps define a slot therebetween for receiving the second end of the anchor bar.

4. The apparatus of claim 3, wherein each of the first and second bar clamps includes a slot aligned opposite one another to define an enclosed aperture sized to slidably receive the second end of the anchor bar.

5. The apparatus of claim 1, wherein the first end of the anchor bar comprises one or more holes for receiving respective one or more fasteners of the second set for securing the first end to a housing of the tool.

6. The apparatus of claim 1, wherein the setup platform comprises: a work surface member including the substantially planar upper surface; and a platform base attached to a lower surface of the work surface member opposite the upper surface.

7. The apparatus of claim 1, wherein the first edge including two substantially straight edges that extend substantially parallel to one another and are offset from one another by an intermediate edge, thereby providing a shape corresponding to a tool housing to which the setup platform is to be secured.

8. The apparatus of claim 1, further comprising a predetermined pattern of holes in the substantially planar upper surface.

9. The apparatus of claim 8, wherein the pattern of holes includes one of a grid pattern and an arc pattern of holes.

10. The apparatus of claim 1, wherein the tool is a bench top or pedestal grinder comprising a cutoff wheel, and wherein the first end of the anchor bar is secured to a wheel guard or other housing of the cutoff wheel.

11. The apparatus of claim 1, further comprising a plate movably mounted to the setup platform and at least partially covering the slot to change a width of the slot.

12. A system for processing work pieces, comprising: a machine tool including a housing and a processing wheel defining a rotational axis; an anchor member including a first end secured to the housing by one or more fasteners and a second free end extending from the housing substantially perpendicular to the rotational axis and defining a substantially horizontal axis; a setup platform comprising a substantially planar upper surface including a slot therein, and a lower surface from which a post extends to define a substantially vertical axis, the post mountable at one or more locations on the anchor member such that the setup platform is directable along the substantially horizontal axis towards the tool until a first edge of the setup platform is positioned at least partially along the housing of the tool and the wheel is received in the slot; and one or more fasteners for securing the post to the anchor member to thereby secure the setup platform relative to the tool, wherein the tool is a bench top or pedestal grinder, and wherein the wheel is a cutoff wheel.

13. The system of claim 12, wherein the first edge including two substantially straight edges that extend substantially parallel to one another and are offset from one another by an intermediate edge, thereby providing a shape corresponding to the housing.

14. The system of claim 12, further comprising a predetermined pattern of holes in the substantially planar upper surface.

15. A method for mounting a setup platform to a bench top or pedestal grinder having a cutoff wheel rotatably mounted thereon, comprising: mounting a first end of an anchor bar to a housing of the grinder adjacent the cutoff wheel such that the anchor bar defines a substantially horizontal axis between the first end and a second free end of the anchor bar; providing a setup platform including a substantially planar upper surface and an elongate member comprising an upper end fixed to a lower surface of the setup platform and a lower end, the upper and lower ends defining a substantially vertical axis orthogonal to the substantially horizontal axis; positioning the elongate member along the substantially horizontal axis at a desired location between the first end and the second free end of the anchor bar until an inner edge of the setup platform is positioned adjacent the cutoff wheel; and securing the elongate member to the anchor bar such that the setup platform is substantially stationary relative to the grinder, wherein sliding the elongate member along the substantially horizontal axis comprises inserting the second free end of the anchor bar into an aperture in the lower end of the elongate member, and wherein securing the elongate member to the anchor bar comprises clamping the anchor bar within the aperture.

16. A method for mounting a setup platform to a bench top or pedestal grinder having a cutoff wheel rotatably mounted thereon, comprising: mounting a first end of an anchor bar to a housing of the grinder adjacent the cutoff wheel such that the anchor bar defines a substantially horizontal axis between the first end and a second free end of the anchor bar; providing a setup platform including a substantially planar upper surface and an elongate member comprising an upper end fixed to a lower surface of the setup platform and a lower end, the upper and lower ends defining a substantially vertical axis orthogonal to the substantially horizontal axis; positioning the elongate member along the substantially horizontal axis at a desired location between the first end and the second free end of the anchor bar until an inner edge of the setup platform is positioned adjacent the cutoff wheel; and securing the elongate member to the anchor bar such that the setup platform is substantially stationary relative to the grinder, wherein mounting a first end of an anchor bar comprises mounting the first end to a wheel guard of the grinder using a plurality of fasteners.

17. The method of claim 15, wherein the inner edge includes a slot therein and wherein the cutoff wheel is partially received in the slot when the inner edge of the setup platform is positioned adjacent the cutoff wheel.

18. A system for processing work pieces, comprising:

a machine tool including a housing and a processing wheel defining a rotational axis;

an anchor member including a first end secured to the housing by one or more fasteners and a second free end extending from the housing substantially perpendicular to the rotational axis and defining a substantially horizontal axis;

a setup platform comprising a substantially planar upper surface including a slot therein, and a lower surface from which a post extends to define a substantially vertical axis, the post mountable at one or more locations on the anchor member such that the setup platform is directable along the substantially horizontal axis towards the tool until a first edge of the setup platform is positioned at least partially along the housing of the tool and the wheel is received in the slot; and one or more fasteners for securing the post to the anchor member to thereby secure the setup platform relative to the tool, wherein the anchor member comprises a plurality of holes or slots spaced apart from one another between the first and second ends, wherein the post comprises at least one hole, and wherein at least one fastener of the one or more fasteners is receiveable in one of the plurality of holes or slots and the at least one hole to secure the post relative to the anchor member and thereby secure the setup platform relative to the tool.

19. The apparatus of claim 1, wherein the slot extends from the first edge partially across a width of the setup platform towards a second opposite edge.

* * * * *